US006868939B2

(12) United States Patent
Ziehl

(10) Patent No.: US 6,868,939 B2
(45) Date of Patent: Mar. 22, 2005

(54) EXHAUST SILENCER SYSTEM

(75) Inventor: John C. Ziehl, Allegan, MI (US)

(73) Assignee: Vicious Cycle Performance, Inc., St. Charles, IL (US)

( * ) Notice: Subject to any disclaimer, the term of this patent is extended or adjusted under 35 U.S.C. 154(b) by 95 days.

(21) Appl. No.: 10/373,907

(22) Filed: Feb. 25, 2003

(65) Prior Publication Data

US 2004/0163887 A1 Aug. 26, 2004

(51) Int. Cl.[7] ..... F01N 1/24

(52) U.S. Cl. ..... 181/256; 181/247; 181/248; 181/251; 181/252; 181/257; 181/256; 181/268; 181/227; 181/228

(58) Field of Search ..... 181/256, 247, 181/248, 251, 252, 257, 267, 268, 227, 228

(56) References Cited

U.S. PATENT DOCUMENTS

| | | | | |
|---|---|---|---|---|
| 1,844,104 A | | 2/1932 | Schnell | 181/256 |
| 2,016,254 A | | 10/1935 | Noblitt et al. | 181/251 |
| 2,570,728 A | | 10/1951 | Storey | 181/243 |
| 2,613,758 A | | 10/1952 | Cullum | 181/256 |
| 2,671,523 A | | 3/1954 | Walker | 181/264 |
| 2,708,006 A | * | 5/1955 | Backman | 181/225 |
| 2,958,388 A | | 11/1960 | Paulsen | 181/256 |
| 2,990,906 A | | 7/1961 | Audette | 181/256 |
| 3,114,431 A | | 12/1963 | Sanders | 181/256 |
| 3,141,520 A | | 7/1964 | Kurtze | 181/247 |
| 3,563,338 A | | 2/1971 | Rader | 181/243 |
| 3,791,483 A | | 2/1974 | Vasiljevic | 181/252 |
| 4,108,276 A | | 8/1978 | Hall et al. | 181/256 |
| 4,192,402 A | | 3/1980 | Nakagawa et al. | 181/256 |
| 4,226,298 A | | 10/1980 | Bancel et al. | 181/226 |
| 4,239,091 A | | 12/1980 | Negrao | 181/243 |
| 4,252,212 A | | 2/1981 | Meier | 181/248 |
| 4,263,982 A | | 4/1981 | Feuling | 181/256 |
| 4,444,288 A | * | 4/1984 | Sekiya et al. | 181/258 |
| 4,715,472 A | | 12/1987 | McKee | 181/241 |
| 5,633,482 A | | 5/1997 | Erion et al. | 181/282 |
| 5,969,299 A | | 10/1999 | Yamaguchi et al. | 181/227 |
| 6,082,488 A | | 7/2000 | Lin | 181/256 |
| 6,098,745 A | * | 8/2000 | Zalben | 181/282 |
| 6,213,251 B1 | | 4/2001 | Kesselring | 181/249 |
| 6,332,511 B1 | | 12/2001 | Parlato et al. | 181/282 |

FOREIGN PATENT DOCUMENTS

| | | |
|---|---|---|
| GB | 2231916 A | 11/1990 |

* cited by examiner

*Primary Examiner*—Shih-Yung Hsieh
(74) *Attorney, Agent, or Firm*—Price, Heneveld, Cooper, DeWitt & Litton

(57) ABSTRACT

An improved exhaust system for an internal combustion engine generally comprises two expanding megaphones, separated by a dual core annular flow silencing section. The two or split megaphone design facilitates broadening of the time of the negative pressure wave to provide a desirable broad range power output while substantially reducing obnoxious sound output.

13 Claims, 2 Drawing Sheets

EXHAUST SILENCER SYSTEM

FIELD OF THE INVENTION

This invention relates to motor vehicle exhaust systems, and more particularly to an exhaust system that employs a sound attenuating device that achieves a combination of improved power output and sound reduction.

BACKGROUND OF THE INVENTION

The exhaust system for an internal combustion engine is designed to perform a plurality of important functions. A primary function of the exhaust system is convey hot exhaust gases away from the engine and discharge the exhaust gases to atmosphere at a location and in a direction away from the operator of the engine. In the case of motorized vehicles, the exhaust gases are preferably discharged from the rear of the vehicle to minimize driver and passenger exposure to the exhaust gases. Another important function of the exhaust system is to silence or muffle hazardous and objectionable noises. However, in general, exhaust systems achieving improved sound dissipation and/or sound absorption do so at the expense of reduced performance, i.e., lower horsepower.

Thus, it has been an objective of the vehicle manufacturers and others employing internal combustion engines to provide an exhaust system that achieves excellent sound absorption and/or sound dissipation, while also achieving optimum performance ratings.

SUMMARY OF THE INVENTION

The invention provides an improved exhaust system for an internal combustion engine that achieves outstanding sound muffling/silencing properties while maintaining a high performance output.

The advantages of improved sound muffling properties in combination with excellent performance properties are achieved by an exhaust system having a muffler including an outer shell having imperforate walls, an intermediate shell having perforated walls spaced inwardly of the outer shell walls, and sound absorbing material disposed within a first volume defined by the outer shell and the intermediate shell. An inner shell having perforated walls spaced inwardly of the intermediate shell walls defines a second volume in which sound absorbing material is disposed. The walls of the inner shell and the intermediate shell define an annular space for flow of exhaust gases from an internal combustion engine. An inlet pipe to the inlet end of the annular space has a variable inner diameter that increases in the direction of flow of the exhaust gases. An outlet pipe from the outlet end of the annular space has an inner diameter that also increases in the direction of flow of the exhaust gases. A tapered flow diverter projects from the intermediate shell away from the inlet end of the annular space. The flow diverter has a leading tip and diverging imperforate walls for guiding exhaust gases into the annular space.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
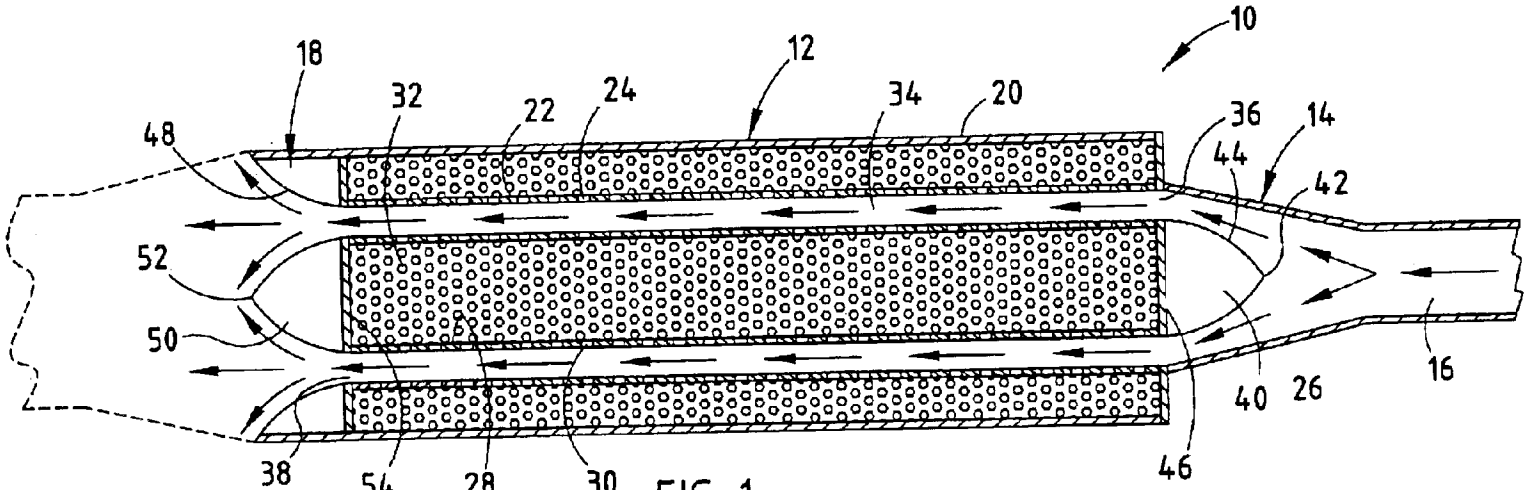
FIG. 1 is a longitudinal cross section of an exhaust system in accordance with the invention.

In FIG. 1, there is shown an exhaust system 10 including a muffler section 12, a diffuser section 14 for conveying exhaust gases from a head pipe 16 to the muffler section 12, and an outlet pipe 18 for conveying exhaust gases from the muffler section 12 to the remaining portion or portions of the exhaust system (not shown), which may include other tailpipe sections. The reference to a muffler section 12, diffuser or inlet pipe 14 and an outlet pipe 18 are meant to define functional sections of the exhaust system, and do not necessarily imply separate structural components.

The muffler or silencer section 12 of the exhaust system includes an outer shell 20 having imperforate walls. An intermediate shell 22 having perforated walls defined by perforations 24 is spaced inwardly of the outer shell walls 20. Tapered flow diverters or megaphone sections (discussed later) provide negative pressure pulses toward the engine.

A sound absorbing material 26 is disposed in a first volume defined by and disposed between the outer shell 20 and the intermediate shell 22. An inner shell 28 having perforated walls defined by perforations 30 is spaced inwardly of intermediate shell walls 22. Inner shell 28 defines a second volume having sound absorbing material 32 disposed therein. Defined by and disposed between intermediate shell 22 and inner shell 28 is an annular space 34 through which exhaust gases may flow. The direction of gas flow is indicated by flow arrows in FIGS. 1–3.

Outer shell 20, intermediate shell 22 and inner shell 28 are preferably concentric, and may have a circular, elliptical or oval transverse cross-sectional shape. The annular space for flow of exhaust gases 34 has an inlet end 36 and an outlet end 38. The annular space 34 for flow of hot gases through the muffler section 12 from the inlet end 36 to the outlet end 38 preferably has a constant cross-sectional area. Typically, the cross-sectional area available for flow through annular space 34 is greater than the cross-sectional area available for flow through head pipe 16.

Inlet pipe or diffuser section 14 has a variable inner diameter that increases in the direction of flow of the exhaust gases, increases from the head pipe 16 to the inlet end 36 of the annular space 34. In the illustrated embodiment, inlet pipe 14 is a frustoconical pipe section having a minimum diameter about equal to the diameter of head pipe 16, and a maximum diameter about equal to the diameter of intermediate shell 22.

Projecting from the inner shell 28 away from inlet 36 of the annular space 34 is a tapered flow diverter 40. Flow diverter 40 has a pointed end or leading tip 42 and diverging imperforate walls 44 that guide exhaust gases from head pipe 16 to annular space 34. Flow diverter 40 may have a conical shape or a parabolic shape, with a base 46 having a transverse cross section that conforms with the transverse cross-sectional shape and dimensions of inner shell 28.

Outlet pipe 18 has an inner wall 48 having a variable inner diameter that increases in the direction of flow of the exhaust gases, i.e., increases from the outlet end 38 of annular space 34 toward the tail end of the exhaust system.

In the embodiment shown in FIG. 1, an outlet diverter 50 is provided. Outlet diverter 50 may have a conical or parabolic longitudinal cross section. Outlet diverter 50 includes a trailing tip 52 and a leading base 54 having a transverse cross-sectional shape and size about equal to the transverse cross-sectional shape and size of inner shell 28. Outlet diverter 50 includes walls that converge from outlet end 38 of inner shell 28 defining annular flow volume 34 toward trailing tip 52 to provide an expanding flow path.

In a modern 4-stroke engine, there is a brief period between the end of an exhaust stroke and the beginning of an intake stroke when the camshaft actually has both the intake and exhaust valves open simultaneously. This period of cam timing is known as "overlap." The exhaust system 10 of this invention is able to produce a negative pressure wave at the exhaust valve during overlap. Because intake and exhaust valves are at opposite ends of the combustion chamber, a negative pressure at the exhaust valve during overlap causes a sweeping flow of fresh fuel/air mix from the intake valve to the exhaust valve and effectively removes what would be the remnant portion of the exhaust gas that would dilute the fresh mixture charge. This effect is referred to as "scavenging," since the combustion chamber becomes scavenged or swept clean of burned gases. This can also create a condition of lower than atmospheric pressure in the combustion chamber before the piston begins its downward intake stroke and aid in initiating flow into the cylinder from the intake valve.

The synchronization of negative pressure and overlap timing is dependent on RPM. The best way to achieve suction and overlap harmony is by providing an exhaust that creates suction over a long period of time, and which exhibits inherent tunability to allow time shifting of the suction events to match changes in engine tuning and RPM range demands of different events, i.e., desert races versus stadium races.

In a properly designed performance exhaust system, the propagation of exhaust flow and of sound pressure wave flow are taken into consideration. Exhaust flow can be impeded by sharp bends, reduced pipe diameters and non-aerodynamic obstacles. Exhaust flow is particulate, has mass, and behaves as a fluid. Thus, anything that would normally disrupt a fluid flow, would also slow exhaust flow. The sound pressure wave flow is unaffected by sharp bends, reduced diameters, etc. However, the sound pressure wave flow has properties that may be exploited in the design of an exhaust system. When a confined pressure wave encounters an enlargement in its containment area a negative pressure wave is sent back toward the origin of the pressure wave. Conversely, a reduction in space reflects back a positive pressure wave. Thus, an exhaust pulse that exits from a pipe into atmospheric pressure sends back a negative pressure wave of very short duration that is proportional to the abruptness in the change of its confinement. An exhaust pulse that transitions from a pipe to open atmosphere via a megaphone returns a negative pressure through the pipe of less intensity but of longer duration.

A megaphone exhaust is desirable for broad range power outputs since the longer duration negative pressure wave has a greater possibility of being synchronous with a given cam shaft overlap period. However, a megaphone exhaust is usually very loud.

The invention takes advantage of the desirable broad range power output of a megaphone exhaust while overcoming the undesirable loudness by utilizing two megaphones (i.e., pipe having an increasing cross-sectional area for flow) separated by a dual core annular flow silencing section 12. The split megaphone design facilitates and broadens the time of the negative pressure wave, approaching the effectiveness of a conventional megaphone design without the obnoxious sound output. Unimpeded flow of exhaust gases is aided by an aerodynamic/bullet-shaped flow diverter 40 at the inlet megaphone 14. The exhaust system utilizes a baffleless flow through design that minimizes constrictions that would create undesirable negative pressure harmonics. The exhaust system is changeable and/or tunable to the extent that parabolic or conical diverters 40 and 50 may be used to lengthen and recover negative pressure effects for enhanced evacuation during overlap scavenging timing. The angles and lengths of the megaphone cones 14 and 18 may be changed in conjunction with diverters 40 and 50 to alter the intensity and duration of the negative pressure waves. Accordingly, the exhaust system of this invention may be provided as a kit having changeable diverters and megaphone cones to facilitate tunability for different engines and/or different performance objectives. Enhanced sound absorption is achieved by utilization of a straight-through design having high surface area.

The exhaust 10 may be used with a conventional spark arresting device, which is necessary for legal operation on many state and federal lands. For example, the exhaust systems 10 may be used with a conventional centrifical spark arrester or a screen-type spark arrester.

Sound absorbing materials 26 and 32 may be the same or different. Suitable sound absorbing materials include fibrous metal, glass, polyarimides; glass or ceramic open cell foams; ceramic wool or felt; multiple layers of fine screening; etc. Combinations of these and/or other sound absorbing materials may be used. Perforations 24 and 30 may be arranged in any suitable pattern and have a suitable diameter to optimize sound absorption. In general, it is desirable that the perforations are uniformly spaced apart on shell walls 22 and 28. Circular holes or perforations are preferred, and typically have diameters in the range of from about 0.050 to about 0.375 inch.

Figure 2:
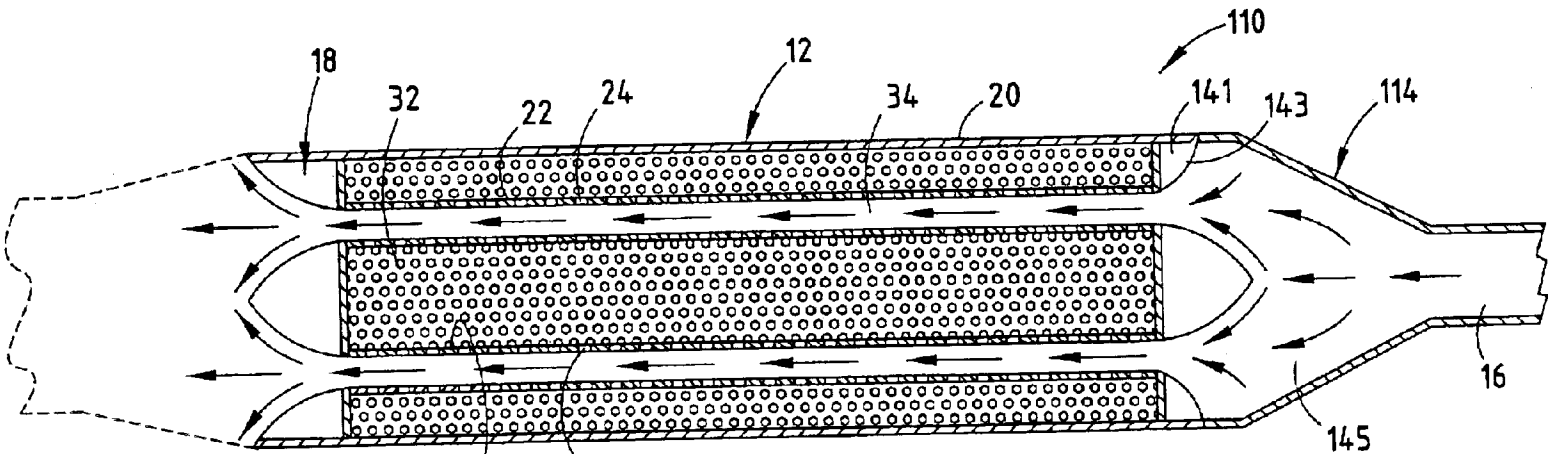
FIG. 2 is a longitudinal cross section of an alternative exhaust system in accordance with the invention.

In FIG. 2, there is shown an alternative embodiment 110. Exhaust system 110 include a muffler section 12 and an outlet pipe section 18 that are similar to those described with respect to the embodiment 10 shown in FIG. 1. However, the inlet pipe section 114 differs to the extent that the inner diameter of section 114 increases to a diameter greater than that of the outer diameter of the annular space 34, i.e., a diameter greater than the diameter of intermediate shell 22. More specifically, the inner diameter of inlet pipe 114 has a minimum diameter about equal to the diameter of head pipe 16, and a maximum diameter about equal to the diameter of outer shell 20. An annular or ring-shaped flow diverter 141 having a surface 143 is provided to smoothly guide (i.e., with a minimum of turbulence) exhaust gases from the enlarged chamber 145 defined by pipe 114 into the annular flow space 34. Flow diverter 141 is radially disposed between outer shell 20 and intermediate shell 22. Surface 143 may be curved in longitudinal cross section (as shown) or flat.

Figure 3:
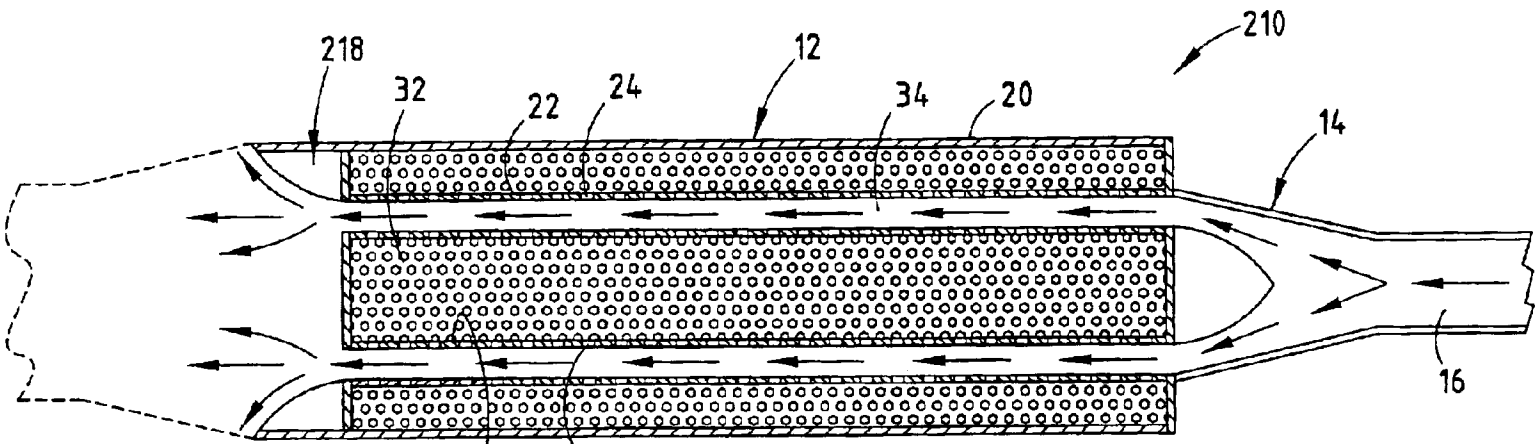
FIG. 3 is a longitudinal cross section of another alternative exhaust system in accordance with the invention.

FIG. 3 shows another alternative embodiment 210 having a muffler section 12 and an inlet pipe section 14 similar to those described with respect to embodiment 10 shown in FIG. 1. However, exhaust system 210 has an outlet pipe section 218 that is generally similar to section 18 of embodiment 10 shown in FIG. 1, except exhaust system 210 excludes the outlet diverter 50 shown in FIG. 1.

Figure 4:
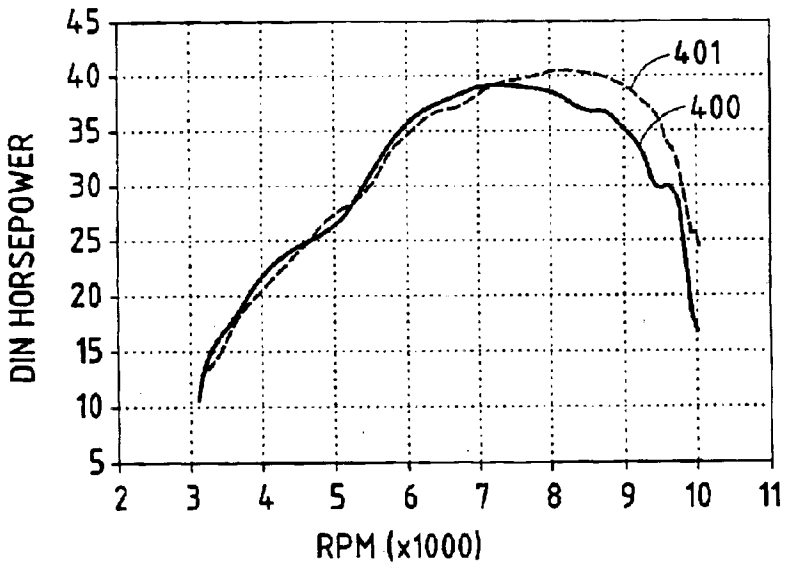
FIG. 4 is graph comparing power output versus decibel output of the invention with power output versus decibel output of a premium commercially available exhaust system.

FIG. 4 is a graph comparing power output as a function of RPM using an exhaust system in accordance with the invention with the power output versus RPM using a premium commercially available exhaust system. Both exhaust systems were tested on the same engine (a Honda TRX400EX) using GT Thunder's DynoJet dynamometer. The power output versus RPM curve for the commercially available (Pro Circuit T-4 Silencer) exhaust system is designated with reference numeral 400, and the curve of power output versus RPM for an exhaust system in accordance with the invention, tested on the same engine, is designated with reference numeral 401. Below about 7500 RPM, the two exhaust systems provided comparable power output. However, above 7500 RPM, the exhaust system in accordance with the invention provided far superior power output (e.g., about 39.5 horsepower for the invention at 9000 RPM versus about 35.5 horsepower for the commercially available exhaust system at 9000 RPM). The commercially available exhaust system is well known for its combination of excellent sound silencing and performance optimization. However, the commercially available exhaust system generated a peak noise of 114 decibels during the dynamometer run, whereas when the exhaust system of the invention was used, a maximum noise level of 109 decibels was observed. Thus, the invention provided a 5-decibel reduction in peak noise level while also achieving enhanced power output above 7500 RPM. It should be kept in mind that decibels are on a logarithmic scale, such that a reduction from 114 decibels to 109 decibels is very significant, especially when the power output is unaffected, and more especially when the power output is actually improved, as is the case with the invention.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. An exhaust system for an internal combustion engine, comprising:

a muffler including an outer shell having imperforate walls, an intermediate shell having perforated walls spaced inwardly of the outer shell walls, sound absorbing material disposed within a first volume defined between the outer shell and the intermediate shell, an inner shell having perforate walls spaced inwardly of the intermediate shell walls, die the inner shell defining a second volume, sound absorbing material disposed within the second volume, the wall with the inner shell and the intermediate shell defining an annular space for flow of exhaust gases from an internal combustion engine, the annular space having an inlet end and an outlet end;

an inlet pipe to the inlet end of the annular space, the inlet pipe having a variable inner diameter that increases in the direction of flow of the exhaust gases;

an outlet pipe from the outlet end of the annular space, the outlet pipe having an inner wall that extends smoothly away from the intermediate shell and toward the outer shell to provide a gradually expanding exhaust flow path from the outlet end of the annular space, thereby reducing abrupt transitions in the exhaust flow path, whereby a negative pressure wave generated when a confined pressure wave encounters an enlargement of the flow path at the outlet end of the annular space is of lower intensity and longer duration than without the inner wall; and an inlet flow diverter that projects from the inner shell away from the inlet end of the annular space, the flow diverter having a leading tip and walls that diverge from the leading tip toward the annular space to guide exhaust gases into the annular space.

2. The exhaust system of claim 1, further comprising an outlet flow diverter that projects from the inner shell away from the outlet end of the annular space, the outlet flow diverter having walls that converge from the outlet end of the inner shell to a trailing tip to provide an expanding flow path.

3. The exhaust system of claim 1, wherein the leading tip of the inlet flow diverter is pointed and the diverging walls of the flow diverter are imperforate.

4. The exhaust system of claim 1, wherein the inlet flow diverter has a parabolic longitudinal cross-sectional shape.

5. The exhaust system of claim 2, wherein the outlet flow diverter includes a leading base having a transverse cross-sectional shape and size about equal to a transverse cross-sectional shape and size of the inner shell.

6. The exhaust system of claim 2, wherein the outlet flow diverter has a parabolic longitudinal cross-sectional shape.

7. The exhaust system of claim 1, wherein the inlet pipe has a maximum diameter approximately equal to the diameter of the intermediate shell.

8. The exhaust system of claim 1, wherein the inlet pipe has a maximum inner diameter about equal to the diameter of the outer shell.

9. The exhaust system of claim 8, further comprising a ring-shaped flow diverter disposed in an annular region within the inlet pipe adjacent the inlet end of the annular space for flow of exhaust gases, and radially disposed between the outer shell and the intermediate shell.

10. The exhaust system of claim 1, wherein the sound absorbing material is a fibrous material.

11. The exhaust system of claim 10, wherein the fibrous sound absorbing material is selected from glass fiber and polyarimides fibrous materials.

12. The exhaust system of claim 1, wherein the outer shell, intermediate shell and inner shell are arranged concentrically.

13. The exhaust system of claim 1, wherein the outer shell, intermediate shell, and inner shell have a transverse cross-sectional shape selected from round, elliptical and oval.

* * * * *

UNITED STATES PATENT AND TRADEMARK OFFICE

CERTIFICATE OF CORRECTION

PATENT NO. : 6,868,939 B2
DATED : March 22, 2005
INVENTOR(S) : John C. Ziehl

It is certified that error appears in the above-identified patent and that said Letters Patent is hereby corrected as shown below:

Column 1,
Line 10, before “convey” insert -- to --.

Column 2,
Line 3, after “is” insert -- a --.

Column 3,
Line 25, “aid” should be -- aids --.

Column 4,
Line 39, “include” should be -- includes --.

Column 5,
Line 48, delete “die” before “the.”.

Signed and Sealed this

Twentieth Day of September, 2005

JON W. DUDAS
*Director of the United States Patent and Trademark Office*